US011495892B2

(12) United States Patent
Nashashibi et al.

(10) Patent No.: US 11,495,892 B2
(45) Date of Patent: Nov. 8, 2022

(54) POLARIZATION-INDEPENDENT SPATIAL POWER DIVIDER FOR A TWO-PORT MILLIMETER-WAVE ANTENNA

(71) Applicant: THE REGENTS OF THE UNIVERSITY OF MICHIGAN, Ann Arbor, MI (US)

(72) Inventors: Adib Nashashibi, Ann Arbor, MI (US); Tanner Douglas, Ann Arbor, MI (US); Kamal Sarabandi, Ann Arbor, MI (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 20 days.

(21) Appl. No.: 17/238,701

(22) Filed: Apr. 23, 2021

(65) Prior Publication Data

US 2021/0344123 A1 Nov. 4, 2021

Related U.S. Application Data

(60) Provisional application No. 63/017,874, filed on Apr. 30, 2020.

(51) Int. Cl.
*H01Q 15/22* (2006.01)
*H01Q 15/24* (2006.01)
(Continued)

(52) U.S. Cl.
CPC ..... *H01Q 25/001* (2013.01); *H01Q 5/28* (2015.01); *H01Q 15/22* (2013.01); *H01Q 15/242* (2013.01)

(58) Field of Classification Search
CPC ..... H01Q 5/28; H01Q 15/22; H01Q 15/242; H01Q 25/001; G01S 13/391
See application file for complete search history.

(56) References Cited

U.S. PATENT DOCUMENTS 4,460,897 A * 7/1984 Gans ..... H01Q 3/36 455/81
2008/0174509 A1* 7/2008 Williams ..... H01Q 15/0073 343/872

(Continued)

FOREIGN PATENT DOCUMENTS

CN 102998670 B 3/2014
WO WO-2006035109 A1 4/2006
WO WO-2021016714 A1 * 2/2021

OTHER PUBLICATIONS

Senhorini, Kathy & Descardeci, J.R. & Bergmann, Jose. (2011). Anisotropic-dielectric-loaded corrugated guide. Journal of Microwaves, Optoelectronics and Electromagnetic Applications. 10. 278-287. 10.1590/S2179-10742011000100026.

(Continued)

*Primary Examiner* — Dameon E Levi
*Assistant Examiner* — Leah Rosenberg
(74) *Attorney, Agent, or Firm* — Harness, Dickey & Pierce, P.L.C.

(57) ABSTRACT

A two-port antenna system is proposed that uses a polarization-independent spatial power divider to align the beams from two orthogonally oriented dual-polarized feeds. This antenna system is compatible with fully polarimetric radar and provides high port isolation. It simultaneously provides a common aperture for transmit and receive to minimize radar parallax. The spatial power divider is designed using a combination of all-dielectric metamaterial techniques and the concept of miniaturized-element frequency selective surfaces, and is fabricated on a silicon wafer using standard microfabrication technology.

17 Claims, 14 Drawing Sheets

(51) Int. Cl.
*H01Q 25/00* (2006.01)
*H01Q 5/28* (2015.01)

(56) References Cited

U.S. PATENT DOCUMENTS

2015/0301275 A1* 10/2015 Andle ..... H01Q 13/0208 385/43
2019/0041493 A1 2/2019 Greenberg et al.

OTHER PUBLICATIONS

Hamid Rajabalipanah et al., "Asymmetric Spatial Power Dividers Using Phase-Amplitude Metasurfaces Driven by Huygens Principle". ACS Omega 2019, 4, 10, 14340-14352. Publication Date: Aug. 21, 2019, https://doi.org/10.1021/acsomega.9b02195.
Kamal Sarabandi, "Simulation of a Periodic Dielectric Corrugation With an Equivalent Anisotropic Layer". International Journal of Infrared and Millimeter Waves, vol. 11, No. 11, 1990.
Yoon, G., Lee, D., Nam, K.T. et al. Geometric metasurface enabling polarization independent beam splitting. Sci Rep 8, 9468 (2018). https://doi.org/10.1038/s41598-018-27876-2.
Hengyi Sun, et al. "Broadband and Broad-angle Polarization-independent Metasurface for Radar Cross Section Reduction". Scientific Reports Jan. 20, 2017, <https://www.ncbi.nlm.nih.gov/pmc/articles/PMC5247760/>.

* cited by examiner

POLARIZATION-INDEPENDENT SPATIAL POWER DIVIDER FOR A TWO-PORT MILLIMETER-WAVE ANTENNA

CROSS-REFERENCE TO RELATED APPLICATIONS

This application claims the benefit of U.S. Provisional Application No. 63/017,874, filed on Apr. 30, 2020. The entire disclosure of the above application is incorporated herein by reference.

FIELD

The present disclosure relates to a polarization-independent spatial power divider for a two-port millimeter-wave antenna.

BACKGROUND

The automotive industry continues to progress toward vehicle autonomy, necessitating implementation of high-reliability sensor systems for obstacle detection and collision avoidance. An essential component of this evolving technology is the millimeter-wave radar for middle- to long-range sensing. Currently, automotive radars operating at 24 GHz and 77 GHz are used in several driver-assistive applications, such as forward collision warning and adaptive cruise control. For more demanding applications, such as the forthcoming autonomous vehicle application, radars with much higher resolution (both in range and cross-range) than existing systems are needed. Enhancing cross-range resolution involves achieving a narrower antenna beamwidth, which can be attained by enlarging the electrical dimensions of the antenna aperture. While this can be accomplished using physically larger antennas, the allotted physical space for automotive radars on vehicles prohibit doubling or tripling the size of the antenna for the traditional 24 GHz and 77 GHz automotive radars. The alternative is to operate the radar at higher millimeter-wave frequencies. Recently, there has been an increased interest in automotive radar systems operating at higher millimeter-wave frequencies, specifically around 230 GHz. More bandwidth is readily available at 230 GHz resulting in improved range resolution. In addition, for the same antenna size, a radar operating at 230 GHz will possess a beamwidth that is 3 times narrower than that at 77 GHz, resulting in much improved angular resolution]. Phenomenological studies of the radar backscatter response of vehicles at J-band were performed recently to identify the scattering phase-centers on vehicles, the significance of cross-polarized return, and the statistics governing the radar response of vehicles. Additional studies are being pursued at J-band to characterize the polarimetric radar response of road surfaces at near grazing incidence in support of road surface assessment and road hazards mitigation applications.

Many millimeter-wave radar systems utilize two separate antennas for transmit and receive, with some separation distance between them. Such designs allow the antennas to be quite compact, for example, by constructing the transmitter and receiver using planar arrays of patch antennas. However, this approach comes with the drawback of radar parallax, where the transmit and receive beams are only well aligned over a certain range of target distances. Another option is to use the standard dual-polarized antenna configuration. This allows for good beam alignment, but takes away the opportunity to implement a fully polarimetric radar system, which is important for distinguishing between obstacles and surfaces of different varieties. In either case, coupling between the transmitter and receiver can be an issue, as the leakage signal from the transmitter can severely interfere with detection of backscatter from the target, even with the best analog and digital signal processing available.

This section provides background information related to the present disclosure which is not necessarily prior art.

SUMMARY

This section provides a general summary of the disclosure, and is not a comprehensive disclosure of its full scope or all of its features.

A two-port antenna system is presented with a polarization-independent spatial power divider. The antenna system includes: a transmit antenna feed; a receive antenna feed; and a spatial power divider. The spatial power divider is comprised of a composite dielectric plate defining two opposing surfaces: a transmit surface and a receive surface. The transmit surface is orientated at forty-five degrees in relation to propagation direction of the transmit signal received from the transmit antenna feed and a receive surface is orientated at forty-five degrees in relation to propagation direction of the receive signal received by the receive antenna feed. One of the two opposing surfaces of the composite dielectric plate includes a series of grooves formed therein and spaced apart from each other at a uniform distance. Each groove defining a longitudinal axis arranged in parallel with other grooves.

In one aspect, the power divider is configured to transmit and reflect signals having a frequency in a band from 221 GHz to 250 GHz such that the transmit signal is transmitted and reflected at a difference less than 0.1 dB for both the transverse electric polarization and the transverse magnetic polarization, and the receive signal is transmitted and reflected at a difference less than 0.1 dB for both the transverse electric polarization and the transverse magnetic polarization.

In another aspect, the power divider is configured to transmit and reflect signals having a frequency in a band from 76 GHz to 84 GHz such that the transmit signal is transmitted and reflected at a difference less than 0.9 dB for both the transverse electric polarization and the transverse magnetic polarization, and the receive signal is transmitted and reflected at a difference less than 0.9 dB for both the transverse electric polarization and the transverse magnetic polarization.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 11A-11D are graphs showing the measured radiation pattern of the antenna system for port 1, TE polarization; port 1, TM polarization; port 2, TE polarization; and port 2, TM polarization.

Figure 12:
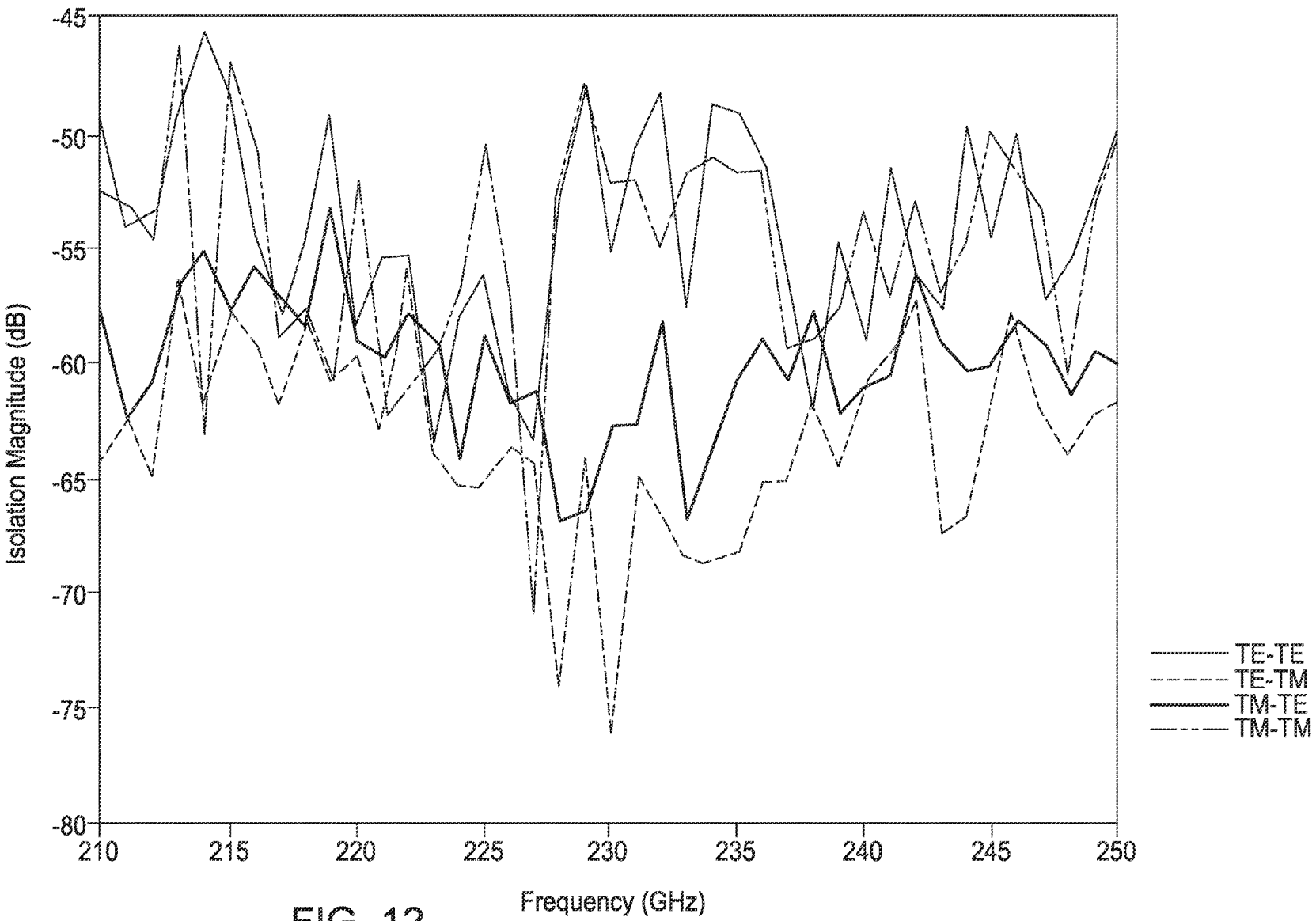

FIG. 12 is a graph showing isolation of the antenna system for all combination of polarizations at the two ports.

Figure 13:
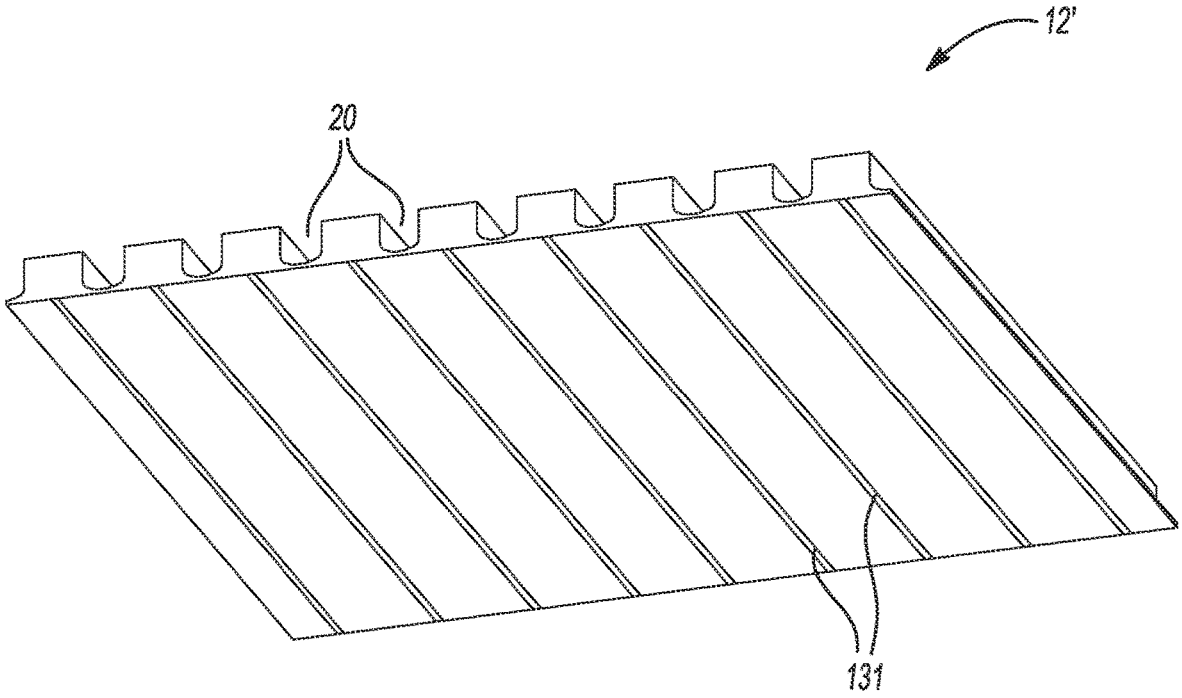

FIG. 13 is a perspective view of an alternative embodiment of the spatial power divider with a series of metal strips deposited thereon.

Figure 14:
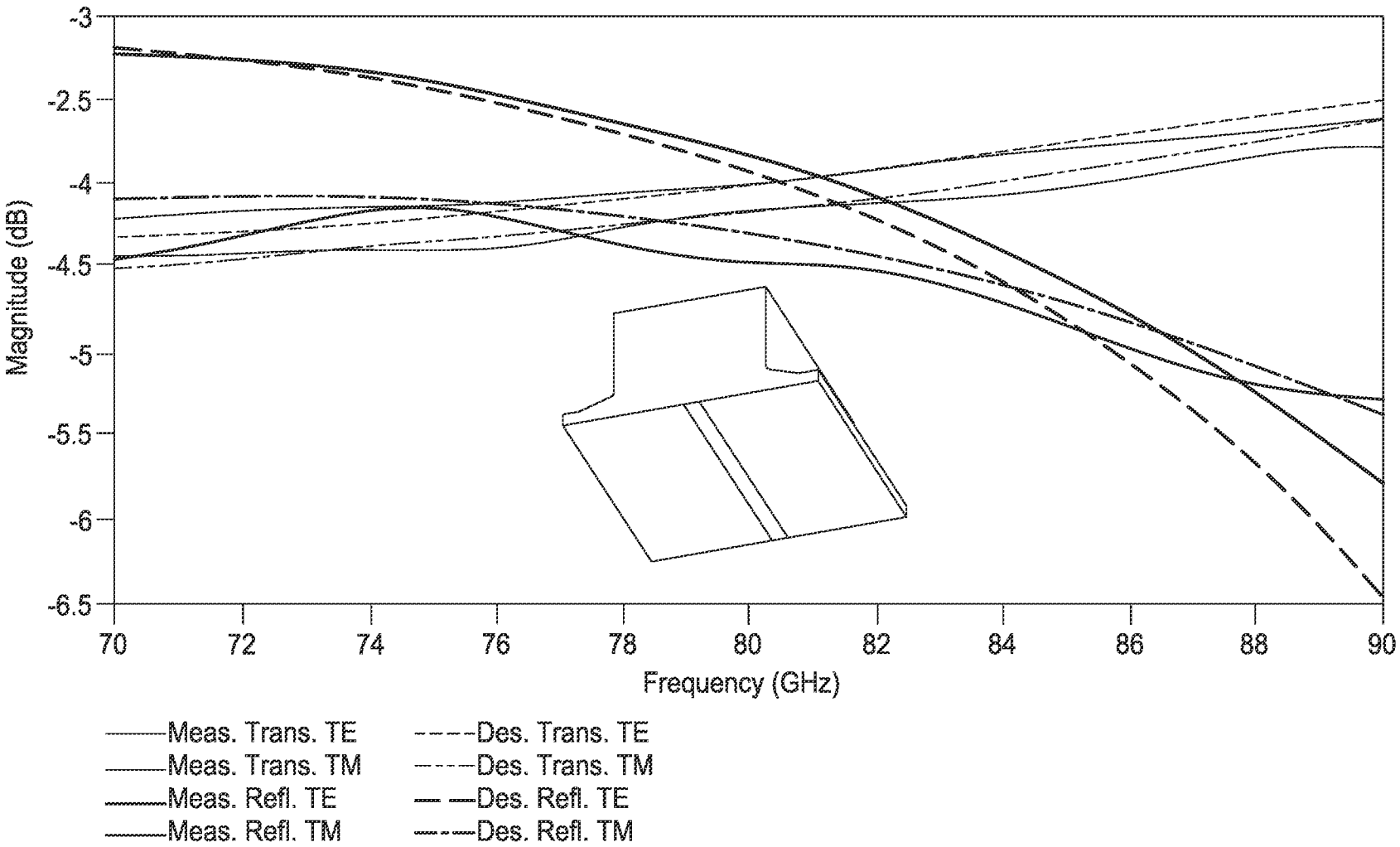

FIG. 14 is a graph showing the measured and simulated reflection and transmission coefficients of the spatial power divider shown in FIG. 13.

Corresponding reference numerals indicate corresponding parts throughout the several views of the drawings.

DETAILED DESCRIPTION

Example embodiments will now be described more fully with reference to the accompanying drawings.

Figure 1:
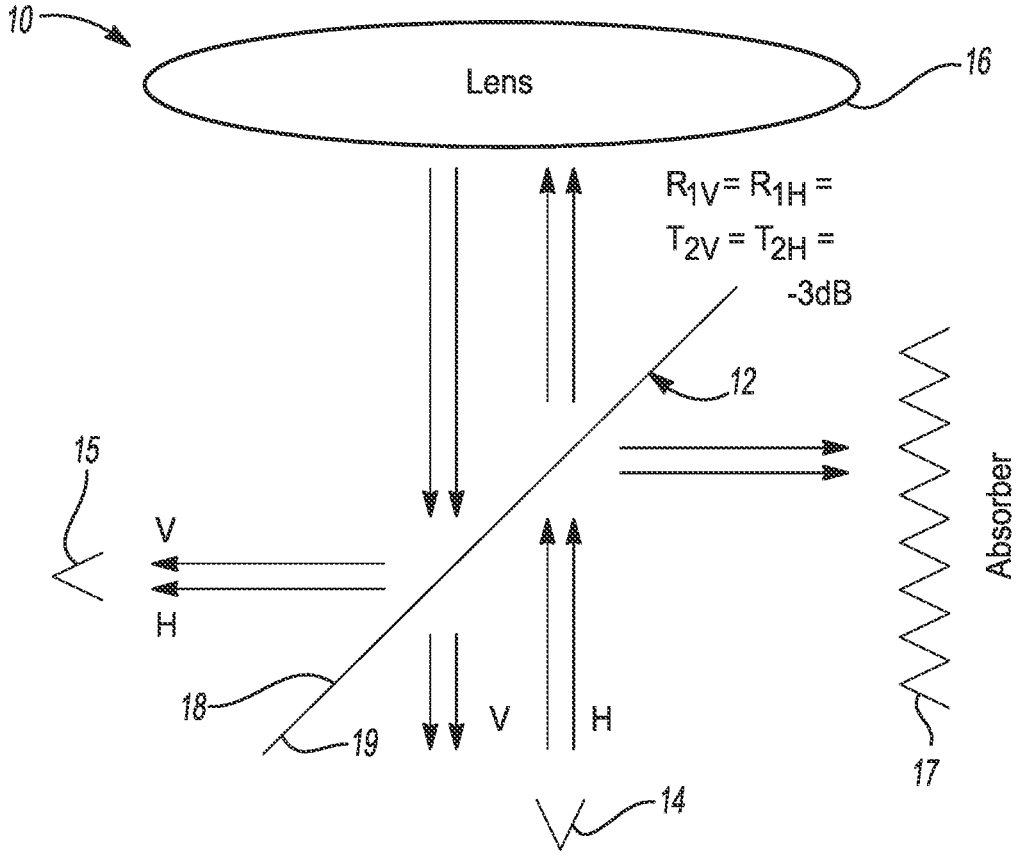
FIG. 1 is a schematic of an example antenna system.

The emerging area of electromagnetic metamaterials is introducing new ways in which propagation can be controlled in a wide variety of application areas. FIG. 1 illustrates an example antenna system 10 with an improved polarization-independent spatial power divider 12 which uses a planar metamaterial slab. The antenna system 10 further includes a transmit feed 14, a receive feed 15, and a lens 16. The antenna system 10 may also include an absorber 17. Each of these components are further described below.

By replacing the wire-grid polarizer with a surface providing equal reflection and transmission for both polarizations at an incidence angle of 45 degrees, one can design an antenna system with high isolation and good beam alignment between the two ports, while being compatible with fully polarimetric radar. One drawback is that half of the power will be lost every time a transmitted or received wave passes through the power divider, but it is anticipated that such losses will be acceptable for the intended application.

By way of background, consider a simple dielectric slab. At normal incidence, a quarter-wave slab with a dielectric constant of approximately 5.83 provides equal reflection and transmission. If one now moves to an oblique incidence angle, it is seen that transmission is reduced for transverse electric (TE) polarization, but increased for transverse magnetic (TM) polarization. On the other hand, if one remains at normal incidence and instead varies the dielectric constant of the slab material, it is seen that reducing the dielectric constant increases transmission, while increasing the dielectric constant reduces transmission. From these simple observations, one can conclude that if one can create an anisotropic material with a lower dielectric constant for TE polarization than for TM polarization, one might be able to achieve equal reflection and transmission for both polarizations at an oblique incidence angle.

Figure 2:
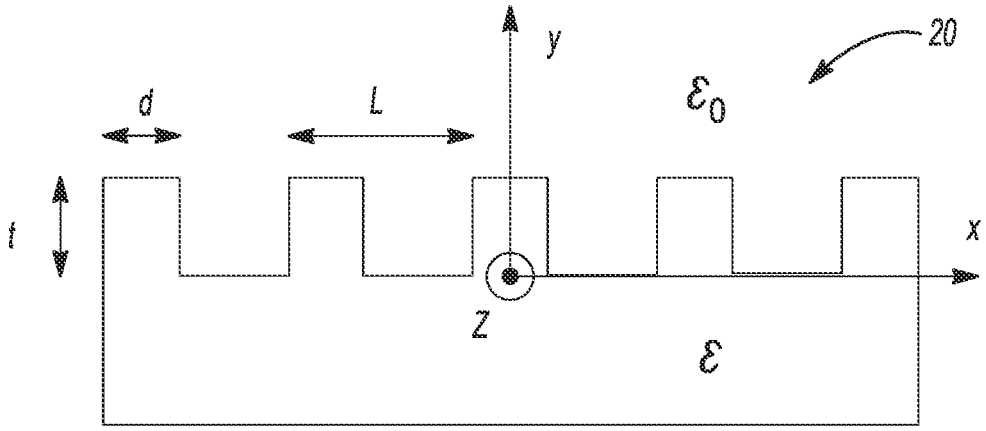
FIG. 2 is a cross-section view of a corrugated dielectric slab.

One way to implement a material with such an anisotropic dielectric behavior is by using a dielectric with periodic corrugations as shown in FIG. 2. This structure can be analyzed first by considering the behavior of a periodic array of slabs infinite in the y and z directions. Once the behavior of this medium is known, the corrugations can be treated as a layer of this material with a finite thickness in the y direction. If the dimension L is small compared to the wavelength, the relative permittivity tensor is given by relatively simple approximate expressions:

$$\overline{\overline{\varepsilon_r}} = \begin{bmatrix} \varepsilon_x & 0 & 0 \\ 0 & \varepsilon_y & 0 \\ 0 & 0 & \varepsilon_z \end{bmatrix} \tag{1}$$

$$\varepsilon_x = \frac{\varepsilon}{\varepsilon(1 - d/L) + d/L} \tag{2}$$

$$\varepsilon_y = \varepsilon_z = 1 + (\varepsilon - 1)\frac{d}{L}. \tag{3}$$

Thus the corrugated slab behaves as a uniaxial medium with its optical axis along the x direction.

Plotting (2) and (3) as a function of the corrugation ratio d/L reveals that $\varepsilon_x<\varepsilon_y$. This suggests that $\varepsilon_x$ should be used for TE polarization and $\varepsilon_y$ for TM polarization. Thus the plane of incidence will be the yz-plane so that the TE electric and displacement fields are parallel to the x-axis (parallel to the optical axis of the uniaxial medium), and the TM electric and displacement fields are parallel to the yz-plane (perpendicular to the optical axis). If one assumes that the material is non-magnetic ($\mu=\mu_0$), then the extraordinary modes of the uniaxial medium are not excited, and the TE and TM cases can simply be treated independently, with $\varepsilon^{TE}=\varepsilon_x$ and $\varepsilon^{TM}=\varepsilon_y$ as the respective effective permittivities in the layer corresponding to the corrugated slab.

It should be noted that for other applications it may be desirable to use the xy-plane as the plane of incidence, in which case the propagation of ordinary and extraordinary waves in a uniaxial medium must be considered to describe the behavior of TE and TM incident waves.

To calculate the total transmission through and reflection from a single corrugated slab layer, the transfer matrix method is used. This technique is readily extended to a cascade of multiple dielectric layers. For each interface between layers, a transfer matrix is defined relating the incident and reflected fields on one side of the interface to those on the other side. Similarly, a transfer matrix is defined for propagation through each layer. Multiplying the matrices together yields the total transfer matrix for the entire cascade.

The transfer matrices for TE and TM incidence are given as follows for the corrugated dielectric medium. Defining, $$k_{y,n}^{TE} = 2\pi f\sqrt{\mu_0\varepsilon_0\varepsilon_n^{TE}}\cos\theta_n^{TE} \tag{4}$$

$$k_{y,n}^{TM} = 2\pi f\sqrt{\mu_0\varepsilon_0\varepsilon_n^{TM}}\cos\theta_n^{TM} \tag{5}$$

$$M_{L,n}^{TE} = \frac{1}{2}\begin{bmatrix} 1 + \dfrac{k_{y,n}^{TE}/\mu_0}{k_{y,n+1}^{TE}/\mu_0} & 1 - \dfrac{k_{y,n}^{TE}/\mu_0}{k_{y,n+1}^{TE}/\mu_0} \\ 1 - \dfrac{k_{y,n}^{TE}/\mu_0}{k_{y,n+1}^{TE}/\mu_0} & 1 + \dfrac{k_{y,n}^{TE}/\mu_0}{k_{y,n+1}^{TE}/\mu_0} \end{bmatrix} \tag{6}$$

-continued $$M_{I,n}^{TM} = \frac{1}{2}\begin{bmatrix} 1+\frac{k_{y,n}^{TM}/\varepsilon_n^{TM}}{k_{y,n+1}^{TM}/\varepsilon_{n+1}^{TM}} & 1-\frac{k_{y,n}^{TM}/\varepsilon_n^{TM}}{k_{y,n+1}^{TM}/\varepsilon_n^{TM}} \\ 1-\frac{k_{y,n}^{TM}/\varepsilon_n^{TM}}{k_{y,n+1}^{TM}/\varepsilon_{n+1}^{TM}} & 1+\frac{k_{y,n}^{TM}/\varepsilon_{n+1}^{TM}}{k_{y,n+1}^{TM}/\varepsilon_{n+1}^{TM}} \end{bmatrix} \quad (7)$$

$$M_{P,n}^{TE} = \frac{1}{2}\begin{bmatrix} \exp(i\cdot k_{y,n}^{TE}\cdot t_n) & 0 \\ 0 & \exp(-i\cdot k_{y,n}^{TE}\cdot t_n) \end{bmatrix} \quad (8)$$

$$M_{P,n}^{TM} = \frac{1}{2}\begin{bmatrix} \exp(i\cdot k_{y,n}^{TM}\cdot t_n) & 0 \\ 0 & \exp(-i\cdot k_{y,n}^{TM}\cdot t_n) \end{bmatrix}. \quad (9)$$

Here $k_{y,n}$ is the propagation constant in the y direction in the $n^{th}$ layer, and $t_n$ is the physical thickness of the $n^{th}$ layer. $M_{P,n}$ is the transfer matrix for propagation through the $n^{th}$ layer, and $M_{I,n}$ is the transfer matrix for the interface between the $n^{th}$ and $(n+1)^{th}$ layers. The index n ranges from 0 to N+1 for a cascade of N dielectric layers (0 and N+1 represent the air on either side). $\theta_n$ is the angle between the propagation vector and the y-axis in the $n^{th}$ layer, and the angles are related by Snell's Law:

$$\sqrt{\varepsilon_n^{TE}}\sin\theta_n^{TE}=\sqrt{\varepsilon_{n+1}^{TE}}\sin\theta_{n+1}^{TE} \quad (10)$$

$$\sqrt{\varepsilon_n^{TM}}\sin\theta_n^{TM}=\sqrt{\varepsilon_{n+1}^{TM}}\sin\theta_{n+1}^{TM} \quad (11)$$

The total transfer matrices for the entire cascade are calculated by multiplying the interface and propagation transfer matrices in sequential order, as follows:

$$M_{total}^{TE}=M_{I,N}^{TE}M_{P,N}^{TE}M_{I,N-1}^{TE}M_{P,N-1}^{TE}\ldots M_{I,1}^{TE}M_{P,1}^{TE}M_{I,0}^{TE} \quad (12)$$

$$M_{total}^{TM}=M_{I,N}^{TM}M_{P,N}^{TM}M_{I,N-1}^{TM}M_{P,N-1}^{TM}\ldots M_{I,1}^{TM}M_{P,1}^{TM}M_{I,0}^{TM} \quad (13)$$

Then the scattering matrices are calculated with the transformation:

$$M = \begin{bmatrix} M_{11} & M_{12} \\ M_{21} & M_{22} \end{bmatrix} \quad (14)$$

$$S = \begin{bmatrix} S_{11} & S_{12} \\ S_{21} & S_{22} \end{bmatrix} = \begin{bmatrix} -M_{21}/M_{22} & 1/M_{22} \\ M_{11}-M_{12}M_{21}/M_{22} & M_{12}/M_{22} \end{bmatrix}. \quad (15)$$

Here, the matrix M represents either $M_{total}^{TE}$ or $M_{total}^{TM}$, the equivalent transfer matrices of the entire cascade. Equation (15) is used to calculate the reflection and transmission coefficients.

Here, the matrix M represents either $M_{total}^{TE}$ or $M_{total}^{TM}$, the equivalent transfer matrices of the entire cascade. Equation (15) is used to calculate the reflection and transmission coefficients.

For a proof of concept, a simple code was written in Matlab to calculate the reflection and transmission coefficients for a cascade of N corrugated dielectric slab layers using (2)-(15). An incidence angle of 45 degrees is used.

For each layer, there are up to three parameters that can be used to design for a desired response: the layer thickness t, the corrugation ratio d/L, and the permittivity E. In practice, not all three parameters can be chosen arbitrarily for each layer. For example, to make fabrication feasible, at least one of the layers should have d/L=1, i.e. the layer is not corrugated, but is instead uniformly composed of a solid isotropic dielectric material.

A more significant restriction applies to the permittivity of the material in each layer, since only values corresponding to a real material may be selected. Silicon ($\varepsilon_r$=11.7) was used for all layers for several reasons. First, the design called for a frequency band near 230 GHz. The free-space wavelength at this band is approximately 1.3 mm. Since the periodicity of the corrugations must be much smaller than the wavelength for the structure to behave as desired, the spatial power divider needs to be fabricated on the micron scale. Standard micro-fabrication techniques are well-established for processing with silicon wafers. In one example, a Deep Reactive Ion Etching (DRIE) process is used to cut trenches into silicon with nearly vertical side walls. In another example, chemical etching may be used to cut the trenches into the silicon, such that the trenches have a trapezoidal cross-sectional shape. This disclosure contemplates other etching techniques as well. In any case, silicon makes sense as the material of choice from a practical standpoint. Additionally, silicon's relatively high permittivity is beneficial, since the effective permittivity for TE and TM polarizations in a corrugated layer are strictly less than the material permittivity, from (2) and (3). It is envisioned that other materials that are compatible with silicon can be used as well, including but not limited to thin films of dielectrics such as silicon dioxide, or photoresists.

In an example embodiment, the spatial power divider uses silicon. While treating the layer thickness and corrugation ratio as free parameters, simulations were ran for cascades of 1 to 5 layers using a genetic algorithm to find the optimal solution. Neither a single corrugated slab layer, nor a cascade of two layers were sufficient to produce approximately equal reflection and transmission for both polarizations over any substantial bandwidth at the desired frequency. However, a three-layer cascade consisting of two anisotropic layers and one isotropic layer was found to provide satisfactory behavior, while four or more layers was not found to significantly improve performance.

Table I shows the parameters giving the optimal performance over a 10 GHz bandwidth centered at 250 GHz.

TABLE I

PARAMETERS FOR THREE-LAYER CASCADE OF CORRUGATED SLABS FOUND BY ANALYTICAL MODEL AND GENETIC OPTIMIZATION ALGORITHM IN MATLAB

| Layer | Thickness t (μm) | Corrugation Ratio d/L |
|---|---|---|
| 1 | 297.5 | 0.9882 |
| 2 | 55.6 | 0.5319 |
| 3 | 162.8 | 0.5953 |

Figure 5:
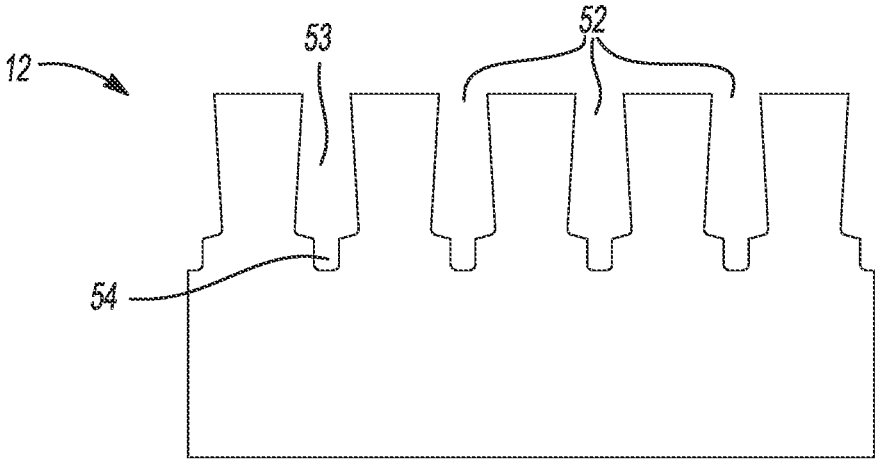
FIG. 5 is a cross-section view of the two-tier groove structure of the corrugated dielectric slab.

With reference to FIGS. 1, 2 and 5, an example embodiment of the proposed spatial power divider 12 according to the analytical modeling is further described. The spatial power divider 12 is comprised of a dielectric plate which defines two opposing surfaces: a transmit surface 19 and a receive surface 18. The transmit surface 19 is orientated at forty-five degrees in relation to propagation direction of the transmit signal and the receive surface 18 is orientated at forty-five degrees in relation to propagation direction of the receive signal as seen in FIG. 1. One of the two opposing surfaces includes a series of grooves 20 spaced apart from each other at a uniform distance (L). Each groove defines a longitudinal axis arranged in parallel with other grooves.

More specifically, each of the grooves in the series of grooves 52 may include a two tier shape with an upper portion 53 and a lower portion 54 as seen in FIG. 5. The upper portion 53 of the groove has a cuboid shape. Similarly, the lower portion 54 of the groove has a cuboid shape but with a width smaller than the upper portion. The parameters for the upper portion and lower portion of the grooves are designed to achieve the desired response. That is, the thickness (or depth) of the upper portion and the ratio of the width of the upper portion of the cuboid to the distance between grooves is configured to achieve a first permittivity exhibited by the dielectric plate; whereas, the thickness (depth) and a ratio of the width of the lower portion of the cuboid to the distance between grooves is configured to achieve a second permittivity exhibited by the dielectric plate, such that the first permittivity differs from the second permittivity. While a two tier shape groove is shown, three or more tiers is also envisioned for some applications.

In this way, the spatial power divider 12 is configured to be polarization-independent. In other words, the spatial power divider 12 in the antenna system 10 is configured to transmit and reflect the transmit signal at a difference less than 0.1 dB for both the transverse electric polarization and the transverse magnetic polarization, as well as transmit and reflect the receive signal at a difference less than 0.1 dB for both the transverse electric polarization and the transverse magnetic polarization.

Figure 3A:
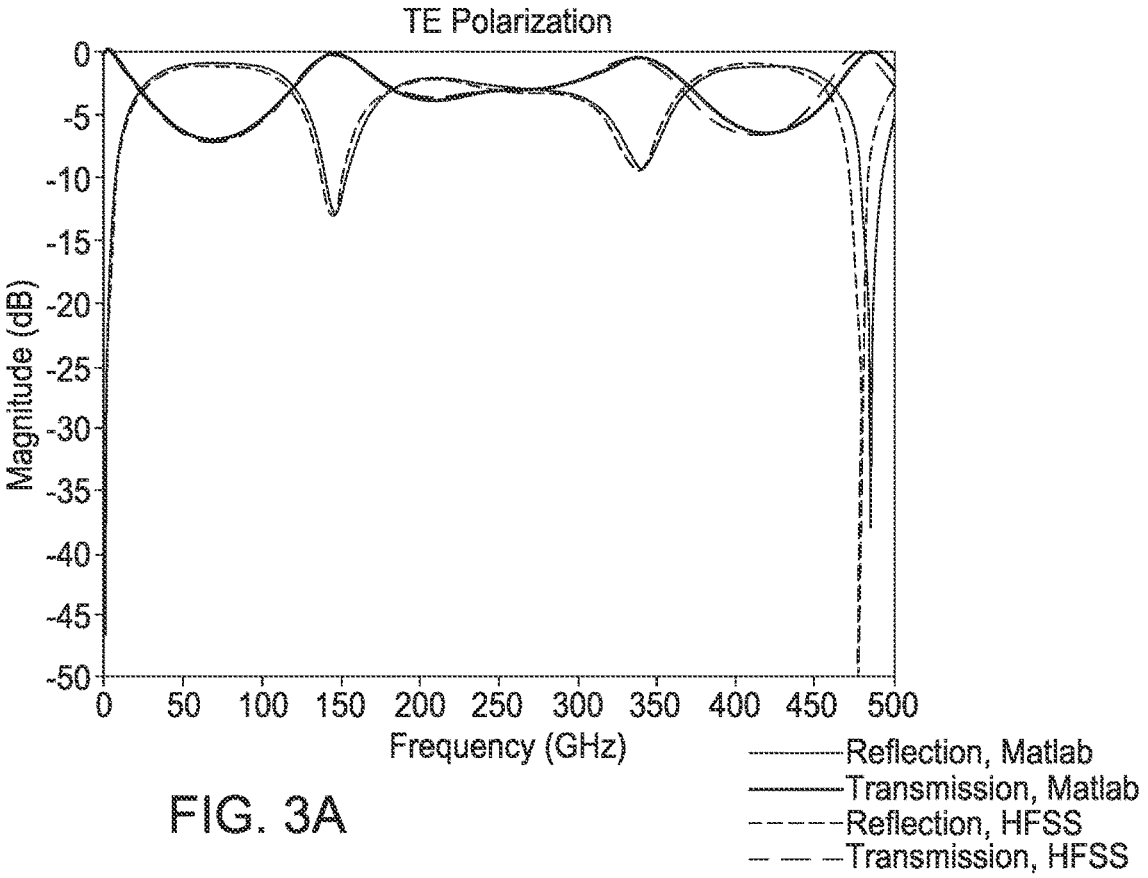
FIGS. 3A and 3B are graphs showing the reflection and transmission coefficients for the spatial power divider for TE polarization and TM polarization, respectively.
Figure 3B:
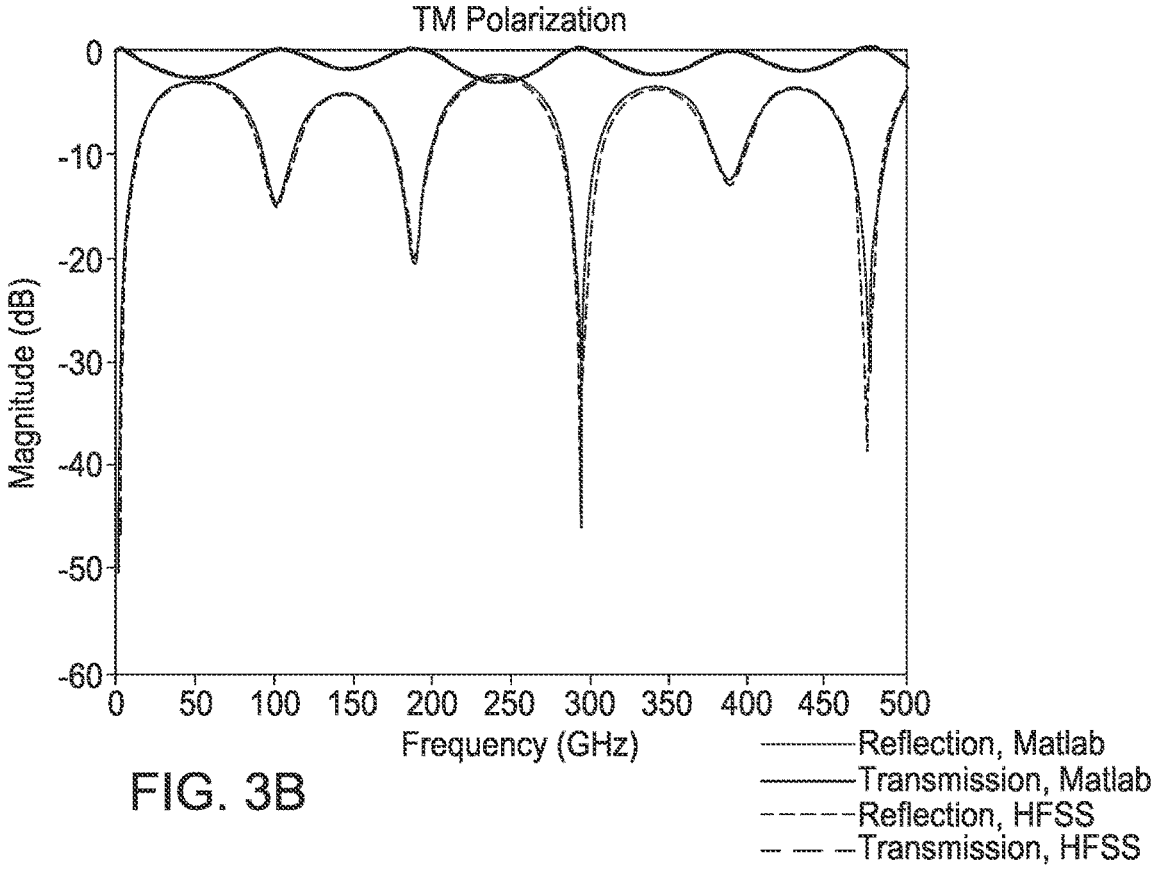

Simulation results for the example embodiment are set forth below. As a starting point, the combination of parameters found with the Matlab model were used for full-wave electromagnetic simulation using Floquet analysis in HFSS. This simulation allows verification of the analytical model, including the validity of the approximations (2) and (3). FIG. 3 displays the reflection and transmission coefficients calculated by both Matlab and HFSS for the solution given in Table I. The two calculations agree very well. One can see that at higher frequencies, there seems to be a slight frequency shift between the analytical solution and simulation, particularly for TE polarization. This is due to reduced accuracy of the approximations in the analytical model as the wavelength becomes smaller compared to the size of the unit cell.

Simulation can also account for non-ideality in the etch profile of DRIE, including non-vertical side walls and curvature of the trench bottom. After including these factors and performing additional optimization, a final design was reached. The parameters are listed in Table II, and the reflection and transmission coefficients are plotted in FIG. 4.

The difference between reflection and transmission is at most 0.1 dB for both polarizations over the band from 227 GHz to 239 GHz. Here, the total thickness of the structure is constrained to be equal to 525 μm, as this is the standard silicon wafer thickness available in The University of Michigan's Lurie Nanofabrication Facility. As a result, frequency scaling is somewhat limited. However, with non-standard wafer thicknesses or precise wafer thinning, it is envisioned that this restriction can be bypassed.

TABLE II

PARAMETERS FOR THREE-LAYER CASCADE OF CORRUGATED SLABS FOUND AFTER CONSIDERING DRIE ETCH PROFILE AND ADDITIONAL OPTIMIZATION IN HFSS

| Layer | Thickness t (μm) | Corrugation Ratio d/L |
|---|---|---|
| 1 | 278.4 | 1 |
| 2 | 52.2 | 0.8252 |
| 3 | 194.4 | 0.5875 |

FIGS. 6A-6L illustrates an example fabrication process for the spatial power divider 12. In this example, the spatial power divider 12 is fabricated on a 100 mm silicon wafer with a thickness of 525 μm. The two layers of corrugations are created by performing a two-step etch with DRIE.

Figure 6A:
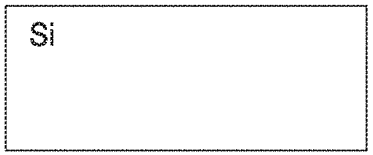
FIGS. 6A-6L are diagrams illustrating an example fabrication process for the spatial power divider.
Figure 6B:
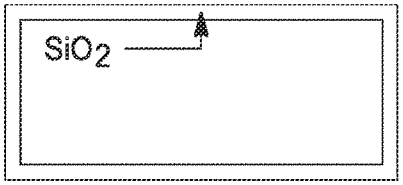
Figure 6C:
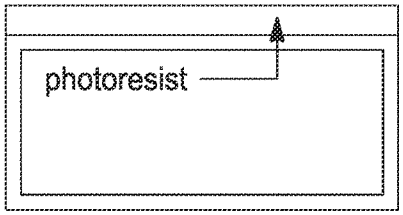
Figure 6D:
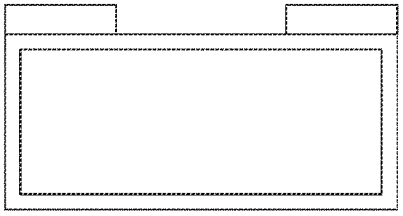
Figure 6E:
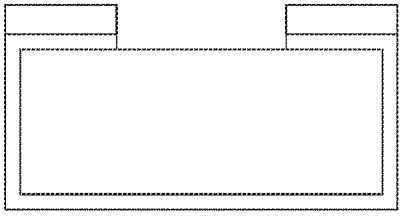
Figure 6F:
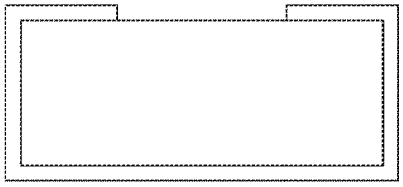
Figure 6G:
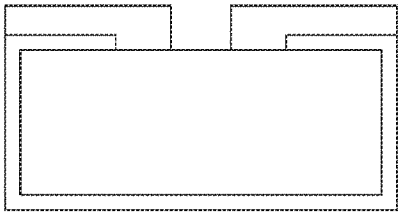
Figure 6H:
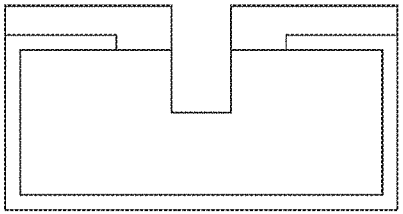
Figure 6I:
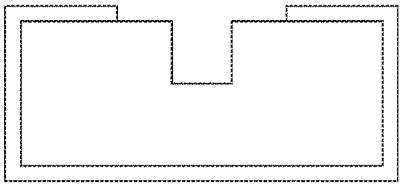
Figure 6J:
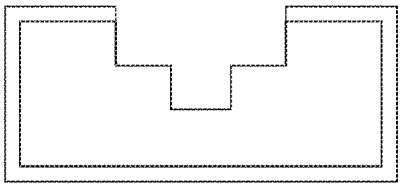
Figure 6K:
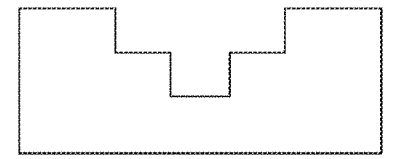
Figure 6L:
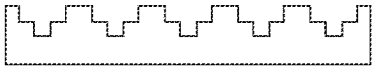

First, a 500 nm layer of silicon dioxide is grown on the wafer through thermal oxidation as seen in FIG. 6B. Then photolithography and RIE are used to etch a series of stripes into the oxide layer. This pattern will act as a mask for the second DRIE etch step. Then a second mask of SPR 220 photoresist is patterned over top of the oxide layer with a set of thinner stripes as seen in FIG. 6G. Referring to FIG. 6H, the first DRIE step is then performed, etching a trench into the silicon which will eventually become the middle layer of the three-layer corrugated slab. The photoresist mask is removed in FIG. 6I, and the oxide mask is used for the second DRIE step as seen in FIG. 6J, which forms the top layer of the corrugated slab, as well as completing the middle.

The fabrication process is fairly straightforward, but there are some factors that make it difficult to do successfully. The first concern is the phenomenon of etch lag: the narrower area at the bottom of the first trench etches more slowly than the wider area at the top during the second etch step. As a result, it is difficult to predict the thickness of the middle layer of the corrugated slab before attempting the process. Even after characterizing the etch rates, they have not been perfectly repeatable in our experience. Another issue is that the silicon is not a perfect insulator (as it is treated in the simulations discussed above), but rather has a finite resistivity that was not known precisely before beginning fabrication.

Because of these factors, it was necessary to fabricate several iterations of the power divider, taking measurements and adjusting both design parameters and process parameters for each iteration. However, to minimize the time and cost of this repetitive process, a new set of masks was not made for each iteration, but rather continued to use the first set of masks. Therefore, control over the widths of the corrugations was lacking.

The measured dimensions of a prototype for the final power divider 12 are displayed in Table III. The side wall angles are measured to be 0.23 degrees, and the width of the unit cell is 200 um ($<\lambda/5$). Measurement results will be discussed below, but it is important to note here that by comparing measurements to simulations, one finds that loss in the silicon is best modeled by introducing a conductivity of 5.82 S/m (corresponding to a resistivity of 17.2 Ωcm and an imaginary part of the relative dielectric constant of $\varepsilon''=0.455$ at 230 GHz). The manufacturer specification for these wafers is given as a resistivity ranging from 10 to 20 Ωcm.

It can be seen that the middle layer is very thin. This is a result of a combination of the lack of control of other design parameters forcing this dimension to become smaller after introducing conductivity into the simulation, and imprecise control over the depth of the etch. As a result, this prototype does not make full use of the three-layer corrugated slab architecture. By adjusting the widths of layers and precisely thinning the wafer to a desired thickness, the design can be improved even further, but the current prototype exhibits good agreement with simulation and adequate performance for a proof of concept.

TABLE III

MEASURED DIMENSIONS OF FINAL PROTOTYPE POWER DIVIDER

| Layer | Thickness t (μm) | Corrugation Ratio d/L |
|---|---|---|
| 1 | 278.5 | 1 |
| 2 | 3.6 | 0.858 |
| 3 | 241.9 | 0.57375 |

Figure 7:
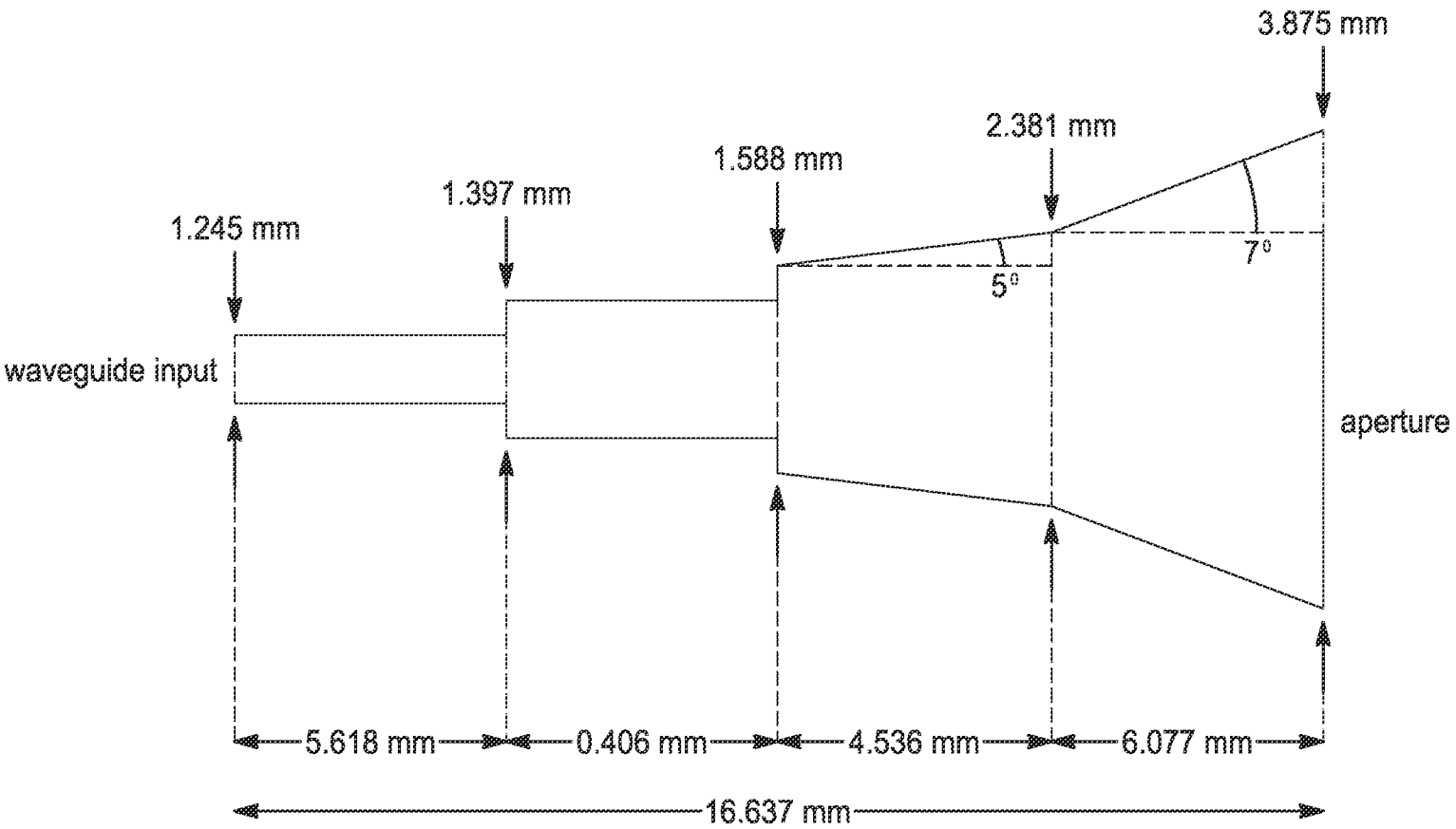
FIG. 7 is a cross-section through the center of an example antenna feed, where the feed has a cylindrical symmetry.
Figure 8A:
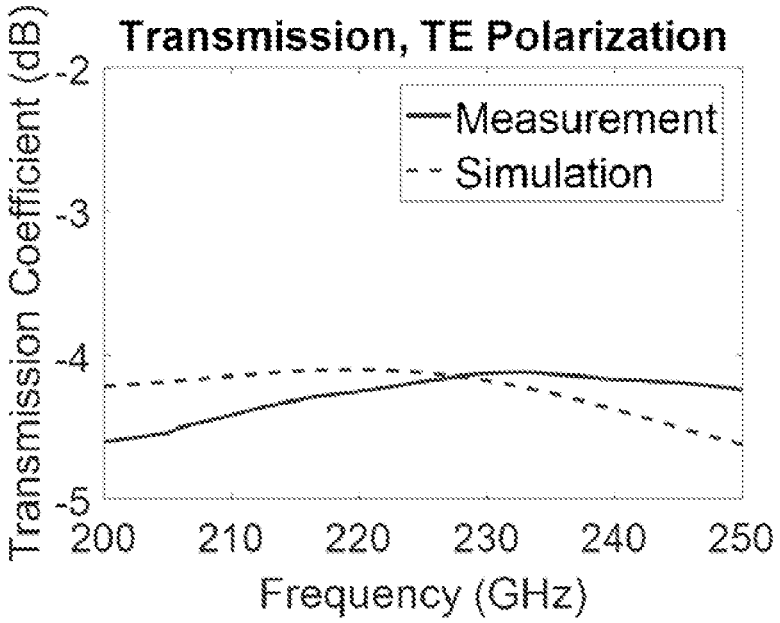
FIGS. 8A-8D are graphs showing the transmission and reflection coefficients of the spatial power divider on individual plots.
Figure 8B:
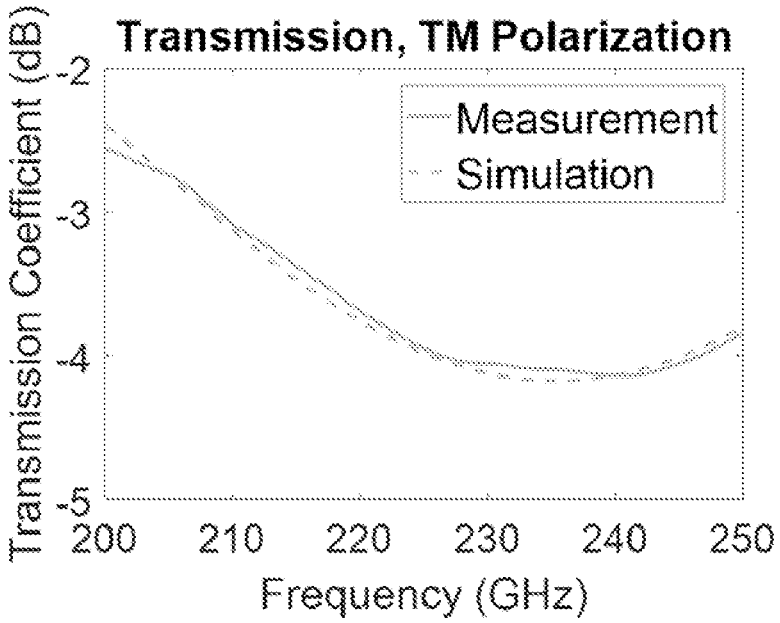
Figure 8C:
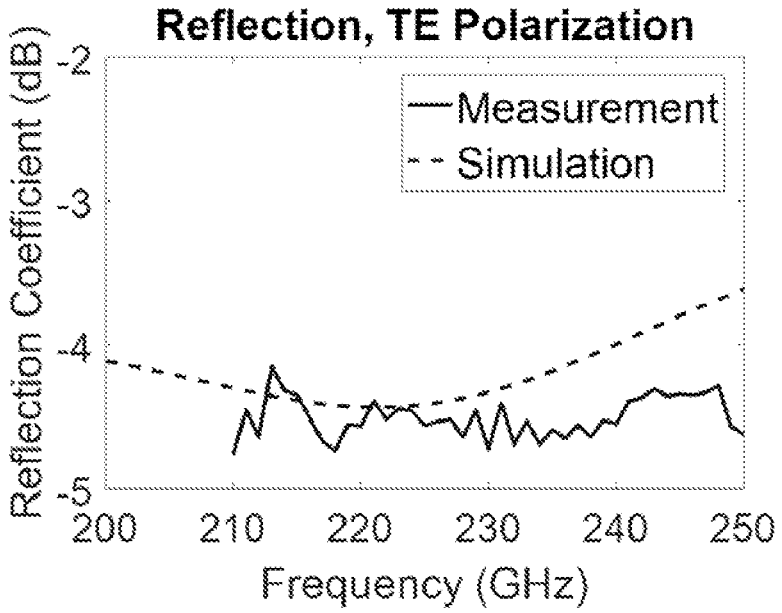
Figure 8D:
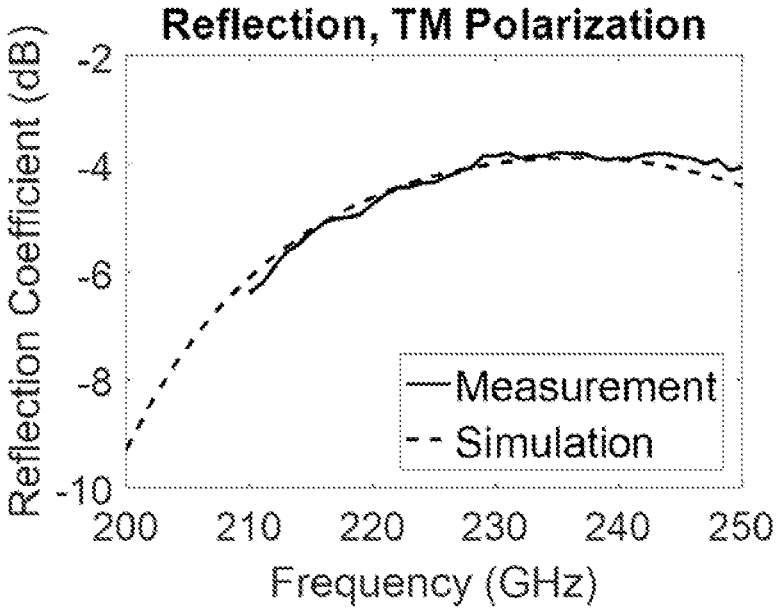
Figure 9:
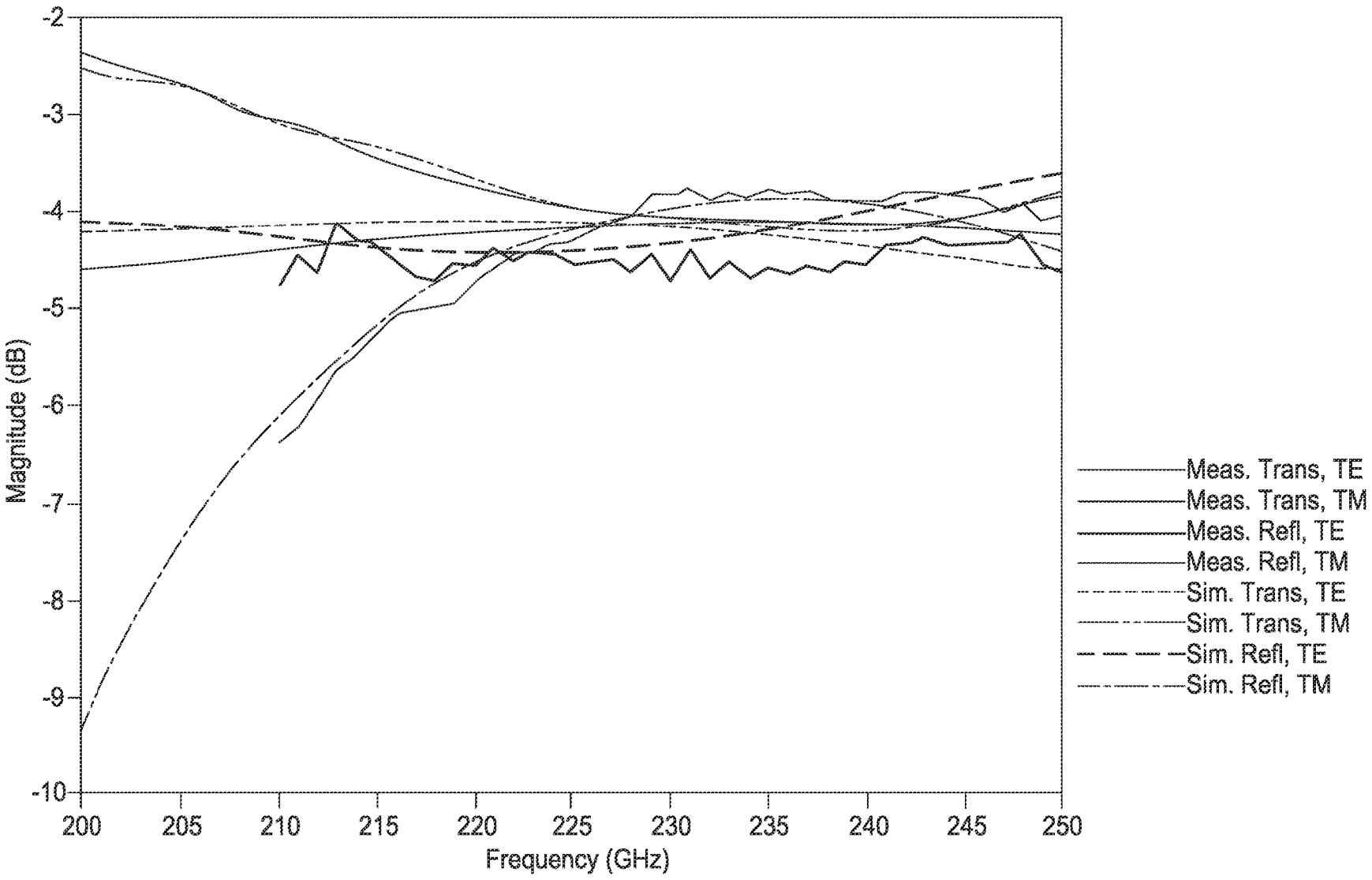
FIG. 9 is a graph showing the transmission and reflection coefficients plotted together for comparison.

With continued reference to FIG. 1, the transmit antenna feed 14 is configured to transit a transmit signal and the receive antenna feed 15 is configured to receive a receive signal. For the example embodiment, a set of conical feeds (or horns) was made from blocks of aluminum using CNC milling. The input is a circular waveguide with a diameter of 1.245 mm (0.049 in.), consistent with the WR-04 standard circular waveguide. The diameter of the aperture is 3.875 mm. The geometry of the conical horn is depicted in more detail in FIG. 7.

The remaining components in the antenna system 10 depicted in FIG. 1 are a lens 16 and an absorber 17. The lens 16 provides a single aperture for the antenna system. That is, incoming signals pass through the lens as well as outgoing signals being transmitted by the antenna system 10. In the example embodiment, the lens is a 10.16 cm (4 in.) diameter Teflon lens with a nominal f/D ratio of 1.4.

The purpose of the absorber 17 is to ensure that the radar does not receive a backscatter signal from objects at ninety degrees from the main beam of the antenna. Thus, the absorber 17 is configured to receive a portion of the transmit signal reflected by the spatial power divider. In the example embodiment, the absorber is the Eccosorb HR-10 absorber commercially available from Laird.

For the prototype, a housing unit was designed and fabricated using 3D printing technology. This housing holds all of the components in their proper locations. The antenna feeds are positioned 3 cm away from the surface of the power divider to ensure that the power divider is in their far field. The housing was designed so that we have the ability to adjust the position of the lens. The nominal focal length is 14.22 cm, but it was found that the gain was maximized when the lens was positioned at 13.91 mm from the aperture of the horn.

Two separate methods were used to measure transmission through and reflection from the power divider at 45-degree incidence. A fixture was 3D-printed to support the power divider at the proper angle.

The transmission was measured using an Agilent N5245 4-port PNA-X performance network analyzer with two waveguide-based OML frequency extenders, which enable measurements up to 325 GHz. At the output of each frequency extender is a standard pyramidal horn to launch waves for free-space measurements. The measurement is calibrated by comparing the response of the power divider to that of free space. Due to unavoidable issues of multi-path transmission, it was found that placing the spatial power divider in the near field of both horns produced more consistent results than positioning everything in the far field. The power divider is close enough to the horn that the beam is still relatively well collimated, so plane wave incidence is a valid approximation. Additionally, time-gating is used to isolate the primary signal path from any residual multi-path effects.

Due to the sensitivity of the frequency extender setup to possible damage during rearrangement, it was impractical to attempt to use the same setup for the reflection measurement, since the two horns need to be oriented at a 90-degree angle from one another. Instead, port 1 of the network analyzer was operated in single-frequency continuous-wave mode, and the reflected wave was received by a Keysight N9020A MXA Signal Analyzer (operating in spectrum analyzer mode) with a Virginia Diodes WR-3.4 spectrum analyzer frequency extender module. The measurement is calibrated by comparing the reflection from the power divider to that of a wafer covered in a layer of gold acting as a perfect electric conductor. To measure over a range of frequencies, the continuous-wave output frequency of the network analyzer was manually adjusted, and the peak was tracked on the spectrum analyzer. Since time-gating is not possible with this setup, one noticed relatively large fluctuations in the reflectivity as a function of frequency due to multi-path. This issue was mitigated by measuring four independent times and averaging.

The measured transmission and reflection coefficients of the spatial power divider for both TE and TM incident waves at 45-degree incidence are shown in comparison to the simulation in FIGS. 8A-8D. The maximum difference between reflection and transmission for either polarization in the band of interest is 0.9 dB.

The gain of both the conical horns and the entire antenna system were measured at 230 GHz using the substitution method, comparing to the gain of the network analyzer frequency extender standard pyramidal horns. The gain of these pyramidal horns at 230 GHz is 22.6 dB. The radiation pattern was measured using the standard far field pattern measurement technique. The pattern was measured in the E- and H-planes for both polarizations, and both co- and cross-polarizations were measured.

Figure 10A:
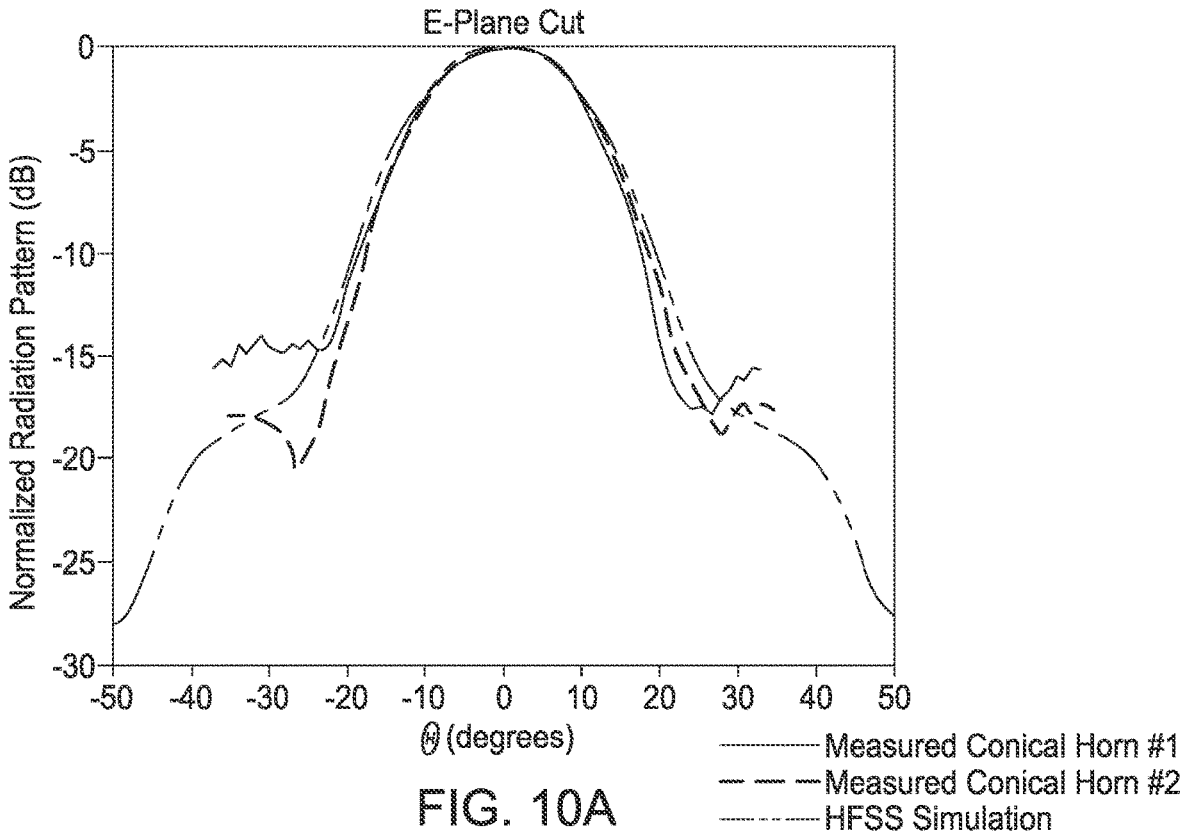
FIGS. 10A and 10B are graphs showing the measured radiation pattern of the conical horn antenna for the E-plane cut and the H-plane cut, respectively.
Figure 10B:
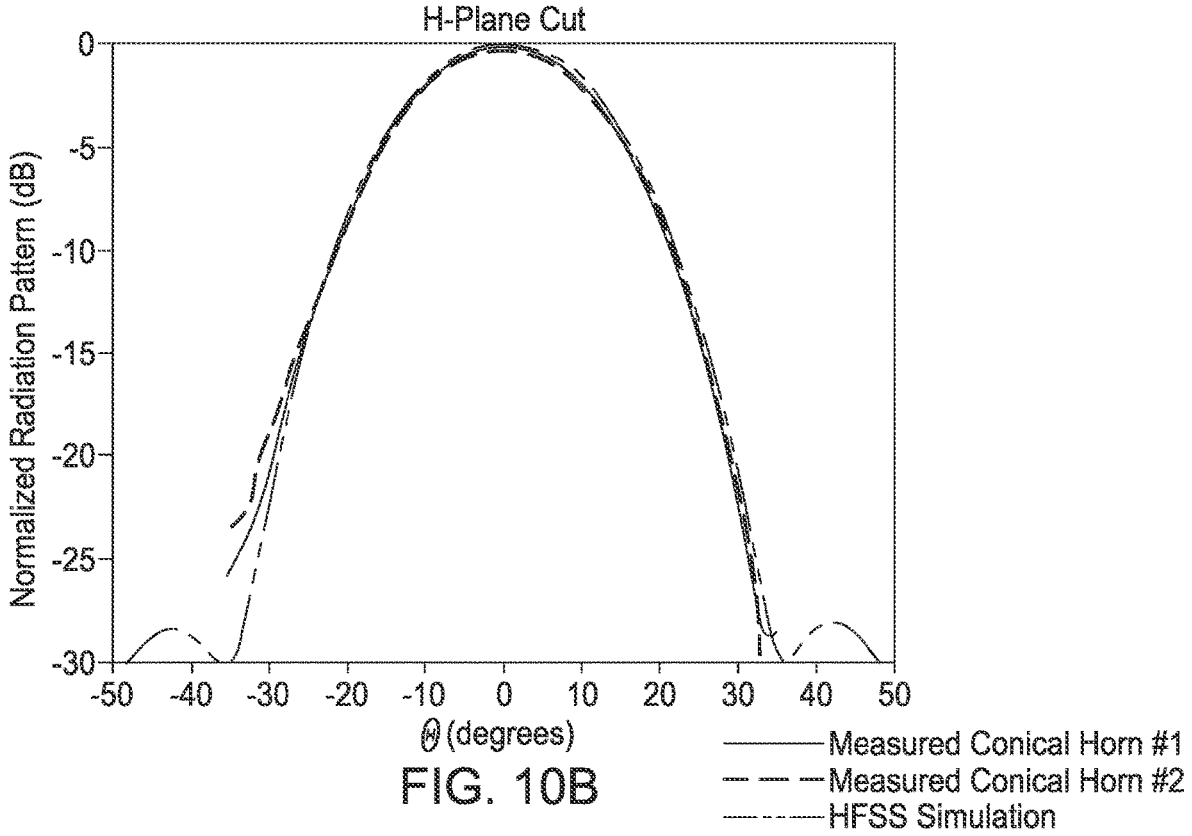
Figure 11A:
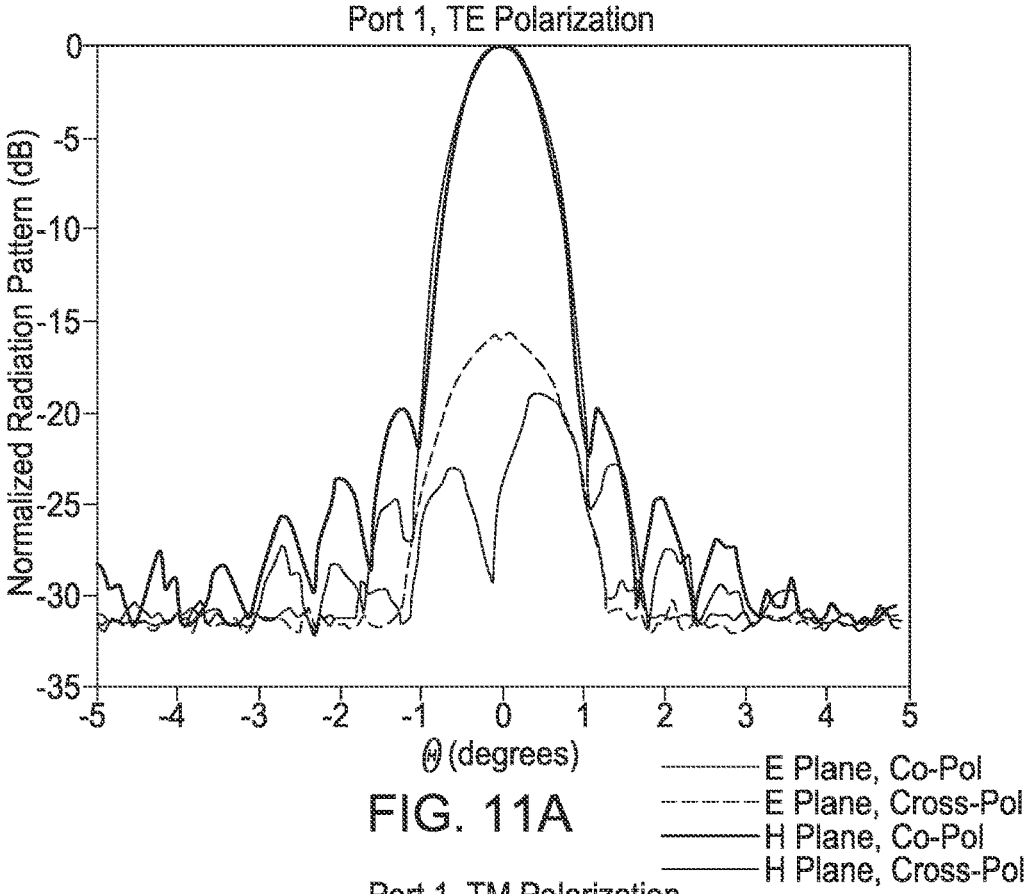
Figure 11B:
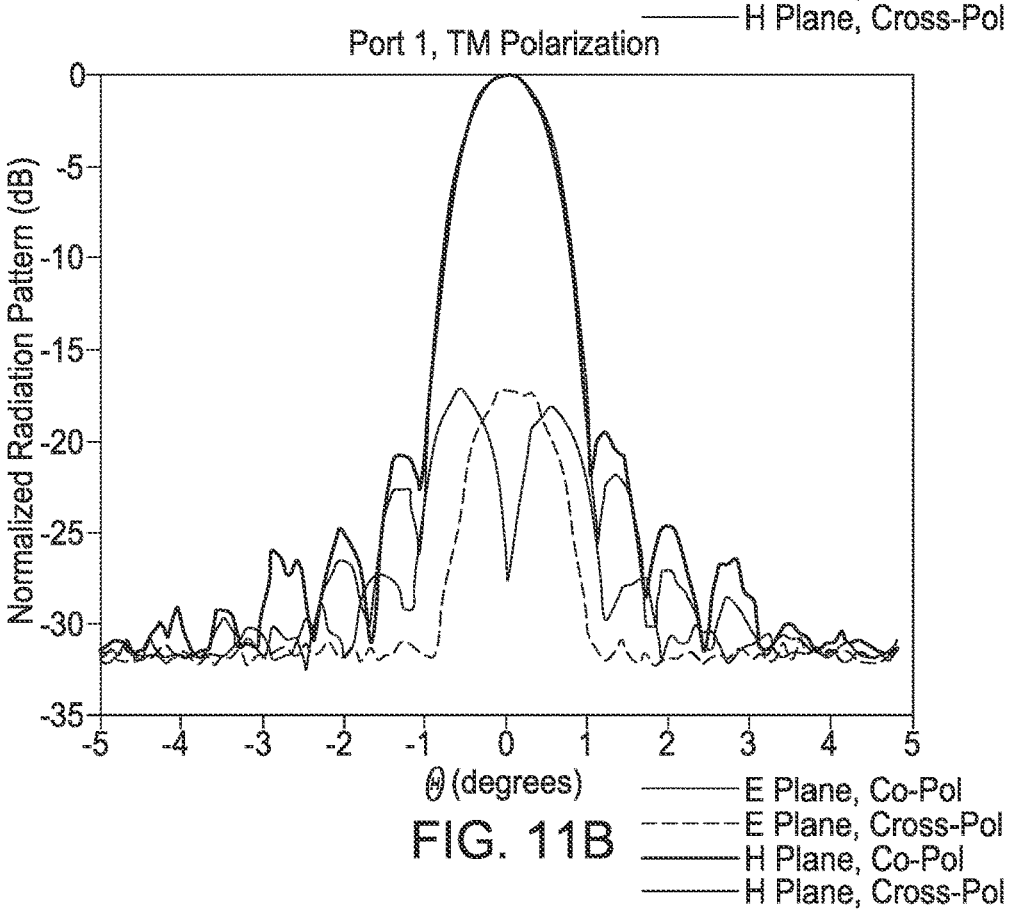
Figure 11C:
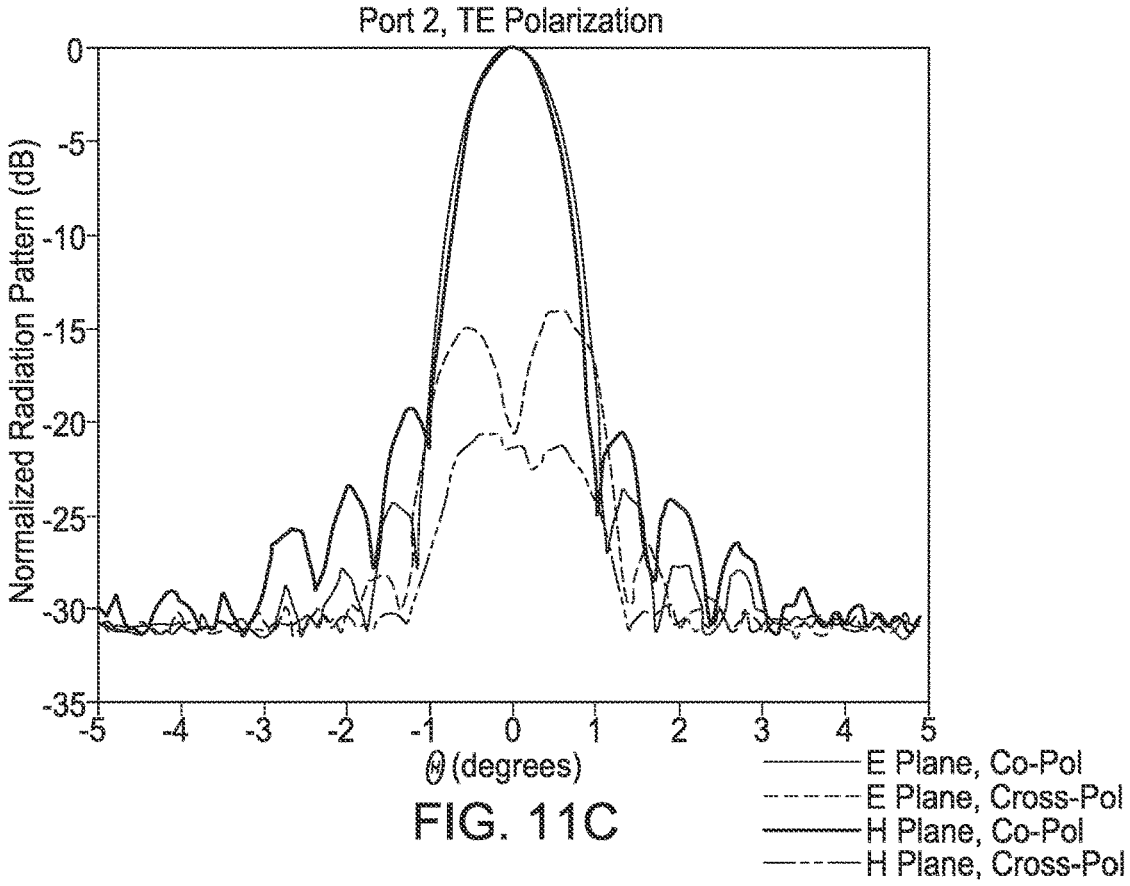
Figure 11D:
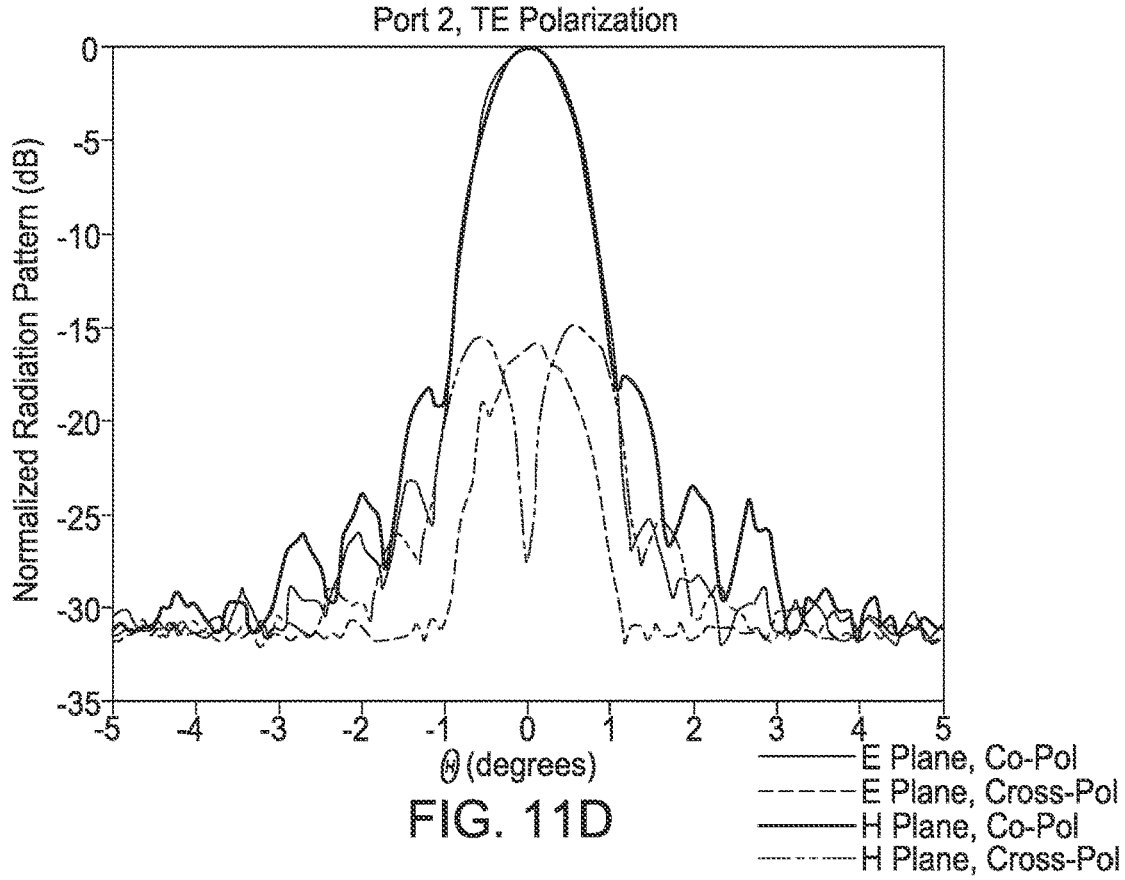

The radiation patterns of the two conical horn antennas are shown in FIGS. 10A and 10B. The gain and beamwidth are summarized in Table IV. The radiation patterns of the full antenna system are shown in FIG. 11, and the characteristics of the pattern are summarized in Table V.

TABLE IV

MEASURED GAIN AND BEAMWIDTH OF CONICAL HORN FEED ANTENNAS

| Horn | Gain (dB) | E-Plane 3-dB Beamwidth (°) | H-Plane 3-dB Beamwidth (°) |
|---|---|---|---|
| 1 | 17.9 | 21 | 24 |
| 2 | 17.6 | 22 | 25 |

TABLE V

MEASURED RADIATION PATTERN CHARACTERISTICS OF ANTENNA SYSTEM

| | Port 1, TE Polarization | Port 1, TM Polarization | Port 2, TE Polarization | Port 2, TM Polarization |
|---|---|---|---|---|
| Gain (dB) | 39.1 | 39.2 | 38.6 | 39.1 |
| E-Plane 3-dB Beamwidth (°) | 1.0 | 1.0 | 1.0 | 1.0 |
| H-Plane 3-dB beamwidth (°) | 0.9 | 0.9 | 0.9 | 0.9 |
| Maximum Sidelobe Level (dB) | −19.9 | −19.6 | −19.4 | −17.6 |
| Maximum Cross-Pol Level (dB) | −15.8 | −17.2 | −14.2 | −14.8 |

The isolation between ports 1 and 2 of the antenna system were measured in a manner similar to the reflection measurement of the spatial power divider. The network analyzer was operated in continuous-wave mode and the signal was collected by the spectrum analyzer. The measurement was calibrated by connecting the output of the network analyzer's frequency extender directly to the input of the spectrum analyzer's frequency extender as a reference of comparison. The isolation is plotted in FIG. 12. Over the band from 200 GHz to 250 GHz, the isolation is better than 45 dB.

Figure 4:
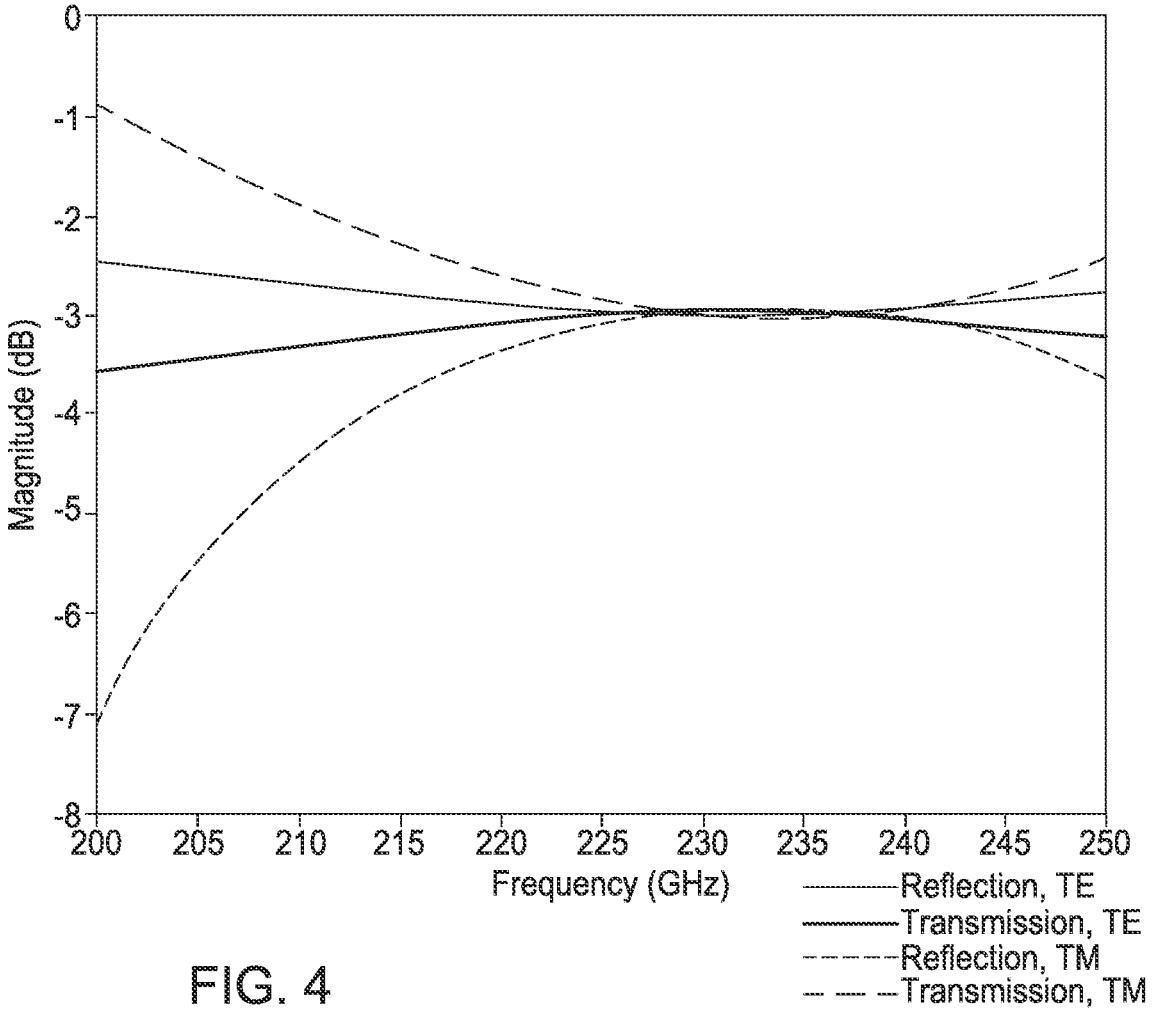
FIG. 4 is a graph showing simulated reflection and transmission coefficients for the spatial power divider.

The original spatial power divider design simulations showed a maximum difference between reflection and transmission for either polarization of 0.1 dB over the band from 227 GHz to 239 GHz (see FIG. 4). The prototype describe above does not perform quite as well, having a difference of at most 0.9 dB over this band. However, the prototype satisfies this specification over the band from 221 GHz to 250 GHz. For comparison, the original simulation has a difference less than 0.9 dB from 219 GHz to 248 GHz, which is the same absolute bandwidth. Therefore, for applications that require higher bandwidth and don't require perfectly equal scattering parameters, the fabricated power divider performs rather well. In order to improve the performance, one needs to adjust the widths of the of the corrugation layers, obtain thin wafers of precise non-standard thickness, and perfect the two-step DRIE process.

Concerning the measured gain of the antenna, which is approximately 39 dB, depending on the port and polarization, note that this falls short of the expectation. Using the following rule of thumb:

$$G = \frac{4\pi A}{\lambda^2} = \frac{4\pi}{BW_{el}BW_{az}}, \tag{16}$$

where A is the antenna aperture and $BW_{el}$ and $BW_{az}$ are the beamwidths in the elevation and azimuth planes, with a 4 in. diameter lens one would expect a gain of about 47.8 dB and a beamwidth of about 0.83°. Since the measured beamwidths in the two planes were 0.9° and 1.0°, one can deduce that we have some gain reduction due to aperture efficiency. This makes sense because with a feed horn beamwidth of about 23° and a focal distance of 5.475 in., the 3 dB spot size at the lens has a radius of about 1.1 in. Therefore, the lens may not be optimally illuminated by the feed horns. Considering the measured beamwidths, the expected gain is in that case about 46.6 dB. The reflection or transmission of the power divider account for around 4.2 dB due to power division and loss. The horns, which have a circular WR-04 waveguide input, are connected to a frequency extender with a rectangular WR-03 waveguide output, so it is known there is considerable mismatch at the interface. Additionally, the horns were made with aluminum, so there is loss in the horns themselves. The combined effect of mismatch and loss in the horns is measured to be about 1.8 dB. So this leaves about 1.6 dB of loss for a theoretical expected value unaccounted for.

Due to fabrication restrictions, the technique described above cannot be scaled directly to spatial power dividers operating at lower frequencies, such as 77 GHz. Therefore, this disclosure further proposes scaling this technique using techniques from miniaturized-element frequency selective surfaces (MEFSS). In particular, periodic metallic wires can be used to increase reflection for one polarization while appearing transparent for the other. The wires can be modeled as inductors in an equivalent circuit model, while the corrugated dielectric slabs can be modeled as transmission lines.

FIG. 13 depicts an example spatial power divider 12' with a series of metal strips 131 deposited on one side of the dielectric plate. Again, the spatial power divider 12' comprised of a dielectric plate defining two opposing surfaces: a transmit surface and a receive surface. The transmit surface is one of the two opposing surfaces orientated at forty-five degrees in relation to propagation direction of the transmit signal received from the transmit antenna feed; whereas, the receive surface is the other of the two opposing surfaces orientated at forty-five degrees in relation to propagation direction of the receive signal received by the receive antenna feed.

In this example, the transmit surface includes a series of grooves 20 formed therein, such that the groove are spaced apart from each other at a uniform distance and each groove defines a longitudinal axis arranged in parallel with other grooves. The receive surface includes a series of metal strips 131 disposed thereon and spaced apart from each other, such that each metal strip defines a longitudinal axis arranged in parallel with the series of grooves. In other examples, the transmit surface includes the metal strips and the receive surface includes the series of grooves.

The design process for the spatial power divider 12' began with the implementation of analytical models in two software tools. First, a code was written in Matlab to calculate the reflection and transmission coefficients from a cascade of corrugated dielectric slabs at oblique incidence using the transfer matrix methods. Second, ADS was used to create equivalent circuit models for these structures using transmission lines and inductors.

Ultimately, the results found from these models were used as starting points for full-wave electromagnetic simulations in HFSS. This allows for verification of the analytical models as well as the inclusion of additional factors such as the imperfect shape of the trenches formed by silicon etching, and loss of the silicon substrate material. At this stage, optimization was used to ensure that the reflection and transmission coefficients for both polarizations were as close to each other as possible.

In one example, the final design consists of a silicon substrate with a total thickness of 525. On one side, corrugations with a period of 1200 and width of 480 μm (d/L=0.6) are etched to a depth of 473 μm. On the other side, gold strips with thickness 0.1 μm and width 64.8 μm are placed with the same spacing. These dimensions are merely illustrative and may vary depending on the design application.

For this example, the spatial power divider was a fabricated using 100 mm silicon wafers. First, the wires were deposited onto the backside of the wafer using evaporation. A layer of 10 nm of chromium was deposited to promote adhesion between the 100 nm of gold and the substrate. Next, deep reactive ion etching was used to form the corrugations on the top side of the wafer. The measured width of the corrugations is 485 μm, and the depth is 477 μm. The measured width of the gold lines is 64.5 μm.

The reflection and transmission coefficients of the fabricated power divider were measured using a network analyzer with frequency extenders enabling measurement at E-Band. The transmission measurement was calibrated by comparing to transmission through free space. The reflection measurement was calibrated by comparing to the reflection from a gold-coated wafer acting as a perfectly conducting surface.

The measured reflection and transmission coefficients are shown in comparison to the simulation in FIG. 14. The difference between reflection and transmission for either polarization is at most 0.9 dB over the band from 76 GHz to 84 GHz. There is approximately 1.1 dB of loss due to finite resistivity, on average over the band and across the four parameters. Thus, the spatial power divider has been designed for an antenna system operating over a band from 76 GHz to 84 Ghz.

While examples of spatial power dividers operating at two particular frequency ranges have been described above, it is readily understood that the techniques set forth herein can be applied to design spatial power dividers operating at other frequency ranges as well.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An antenna system, comprising:

a transmit antenna feed configured to transmit a transmit signal;

a receive antenna feed configured to receive a receive signal; and a spatial power divider comprised of a dielectric plate defining two opposing surfaces, a transmit surface is one of the two opposing surfaces orientated at forty-five degrees in relation to propagation direction of the transmit signal received from the transmit antenna feed and a receive surface is the other of the two opposing surfaces orientated at forty-five degrees in relation to propagation direction of the receive signal received by the receive antenna feed, wherein the power divider is configured to transmit and reflect the transmit signal at a difference less than 0.1 dB for both the transverse electric polarization and the transverse magnetic polarization, and is configured to transmit and reflect the receive signal at a difference less than 0.1 dB for both the transverse electric polarization and the transverse magnetic polarization.

2. The antenna system of claim 1 wherein the dielectric plate is comprised of silicon or other dielectric materials.

3. The antenna system of claim 1 wherein one of the two opposing surfaces includes a series of grooves spaced apart from each other at a uniform distance, each groove defining a longitudinal axis arranged in parallel with other grooves.

4. The antenna system of claim 3 wherein each of the grooves in the series of grooves has a two tier shape with an upper portion and a lower portion, the upper portion of the groove has a cuboid shape and the lower portion of the groove has a cuboid shape with a width smaller than the upper portion.

5. The antenna system of claim 4 wherein a ratio of the width of the upper portion of the cuboid to the distance between grooves in the series of grooves is configured to achieve a first permittivity exhibited by the dielectric plate and a ratio of the width of the lower portion of the cuboid to the distance between grooves in the series of grooves is configured to achieve a second permittivity exhibited by the dielectric plate, where the first permittivity differs from the second permittivity.

6. The antenna system of claim 1 wherein spatial power divider is configured to transmit and reflect signals having a frequency in a band from 221 GHz to 250 GHz.

7. The antenna system of claim 1 further includes a lens placed after the spatial power divider and configured to increase gain of the antenna.

8. The antenna system of claim 1 further includes an absorber configured to receive a portion of the transmit signal reflected by the spatial power divider.

9. An antenna system, comprising:

a transmit antenna feed configured to transmit a transmit signal;

a receive antenna feed configured to receive a receive signal; and a spatial power divider comprised of a dielectric plate defining two opposing surfaces, a transmit surface is one of the two opposing surfaces orientated at forty-five degrees in relation to propagation direction of the transmit signal received from the transmit antenna feed and a receive surface is the other of the two opposing surfaces orientated at forty-five degrees in relation to propagation direction of the receive signal received by the receive antenna feed, wherein one of the two opposing surfaces includes a series of grooves spaced apart from each other at a uniform distance, each groove defining a longitudinal axis arranged in parallel with other grooves, and wherein the spatial power divider is configured to transmit and reflect signals having a frequency in a band from 221 GHz to 250 GHz.

10. The antenna system of claim 9 wherein each of the grooves in the series of grooves has a two tier shape with an upper portion and a lower portion, the upper portion of the groove has a cuboid shape and the lower portion of the groove has a cuboid shape with a width smaller than the upper portion.

11. The antenna system of claim 10 wherein a ratio of the width of the upper portion of the cuboid to the distance between grooves in the series of grooves is configured to achieve a first permittivity exhibited by the dielectric plate and a ratio of the width of the lower portion of the cuboid to the distance between grooves in the series of grooves is configured to achieve a second permittivity exhibited by the dielectric plate, where the first permittivity differs from the second permittivity.

12. An antenna system, comprising:

a transmit antenna feed configured to transmit a transmit signal;

a receive antenna feed configured to receive a receive signal; and a spatial power divider comprised of a dielectric plate defining two opposing surfaces, a transmit surface is one of the two opposing surfaces orientated at forty-five degrees in relation to propagation direction of the transmit signal received from the transmit antenna feed and includes a series of grooves formed therein, such that the grooves are spaced apart from each other at a uniform distance and each groove defines a longitudinal axis arranged in parallel with other grooves; and a receive surface is the other of the two opposing surfaces orientated at forty-five degrees in relation to propagation direction of the receive signal received by the receive antenna feed and includes a series of metal strips disposed thereon and spaced apart from each other, such that each metal strip defines a longitudinal axis arranged in parallel with the series of grooves.

13. The antenna system of claim 12 wherein the power divider is configured to transmit and reflect the transmit signal at a difference less than 0.9 dB for both the transverse electric polarization and the transverse magnetic polarization, and is configured to transmit and reflect the receive signal at a difference less than 0.9 dB for both the transverse electric polarization and the transverse magnetic polarization.

14. The antenna system of claim 12 wherein the dielectric plate is comprised of silicon.

15. The antenna system of claim 12 wherein spatial power divider is configured to transmit and reflect signals having a frequency in a band from 76 GHz to 84 GHz.

16. The antenna system of claim 12 further includes a lens placed after the spatial power divider and configured to increase gain of the antenna.

17. The antenna system of claim 12 further includes an absorber configured to receive a portion of the transmit signal reflected by the spatial power divider.

* * * * *